US010014608B2

(12) United States Patent
Lee et al.

(10) Patent No.: US 10,014,608 B2
(45) Date of Patent: Jul. 3, 2018

(54) ELECTRICAL PLUG CONNECTOR AND ELECTRICAL RECEPTACLE CONNECTOR

(71) Applicant: ADVANCED-CONNECTEK INC., New Taipei (TW)

(72) Inventors: Kuo-Ching Lee, New Taipei (TW); Ta-Teh Meng, New Taipei (TW); Wang-Jie Luo, New Taipei (TW); Cheng-Feng Yu, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/274,063

(22) Filed: Sep. 23, 2016

(65) Prior Publication Data

US 2017/0093063 A1 Mar. 30, 2017

(30) Foreign Application Priority Data

Sep. 25, 2015 (TW) ..... 104215621 U

(51) Int. Cl.
*H01R 12/71* (2011.01)

(52) U.S. Cl.
CPC ..... *H01R 12/716* (2013.01)

(58) Field of Classification Search
CPC .... H01R 12/716; H01R 12/714; H01R 12/79; H01R 12/722; H01R 12/724; H01R 13/20; H01R 13/2442; H01R 13/502; H01R 13/506; H01R 13/514; H01R 13/5202; H01R 13/521; H01R 13/5219; H01R 13/6585
See application file for complete search history.

(56) References Cited

U.S. PATENT DOCUMENTS 7,320,606 B2 * 1/2008 Midorikawa ..... H01R 12/716 439/660
8,858,239 B2 * 10/2014 Little ..... H01R 13/28 439/74
9,484,648 B2 * 11/2016 Takenaga ..... H01R 12/716
9,887,473 B2 * 2/2018 Lee ..... H01R 12/716
2007/0020966 A1 * 1/2007 Lee ..... H01R 13/20 439/74
2008/0305657 A1 * 12/2008 Midorikawa ..... H01R 4/028 439/74

(Continued)

*Primary Examiner* — Truc Nguyen

(74) *Attorney, Agent, or Firm* — Andrew M. Calderon; Roberts Mlotkowski Safran Cole & Calderon, P.C.

(57) ABSTRACT

An electrical plug connector and an electrical receptacle connector adapted to be mated with the electrical plug connector are provided. The electrical receptacle connector includes an insulated housing integrally formed as a whole and a plurality of receptacle terminals. Based on a supporting arm of a first side arm of the receptacle terminal, when the plug terminal is abutted against the first side arm, the supporting arm is abutted against an abutting surface of the electrical receptacle connector for supporting the first side arm and improving the structural strength of the first side arm. Therefore, the first side arm can be prevented from being deformed or broken. In addition, based on a supporting segment of a second side arm of the receptacle terminal, the flexibility of second side arm can be improved and the structural strength of the second side arm can be enhanced.

18 Claims, 8 Drawing Sheets

(56) References Cited

U.S. PATENT DOCUMENTS

| | | | | |
|---|---|---|---|---|
| 2009/0061655 | A1* | 3/2009 | Miyazaki | H01R 12/57 439/74 |
| 2009/0305528 | A1* | 12/2009 | Hirata | H01R 12/716 439/74 |
| 2010/0291776 | A1* | 11/2010 | Huang | H01R 13/2457 439/74 |
| 2013/0137307 | A1* | 5/2013 | Huang | H01R 12/716 439/660 |
| 2013/0330970 | A1* | 12/2013 | Hirata | H01R 12/716 439/620.01 |

* cited by examiner

ELECTRICAL PLUG CONNECTOR AND ELECTRICAL RECEPTACLE CONNECTOR

CROSS-REFERENCE TO RELATED APPLICATION

This non-provisional application claims priority under 35 U.S.C. § 119(a) to Patent Application No. 104215621 filed in Taiwan, R.O.C. on Sep. 25, 2015, the entire contents of which are hereby incorporated by reference.

FIELD OF THE INVENTION

The instant disclosure relates to an electrical connector, and more particular to an electrical plug connector and an electrical receptacle connector.

BACKGROUND

It is a trend for 3C products (i.e., computer, communication, and consumer electronics) to be smaller and lighter. In a portable electronic device, different circuit boards would have to be electrically connected with each other, and since the size of the electronic device is quite small, the interior space of the electronic device is small, too. Therefore, board to board connectors (BTB connectors) are adapted to electrically connect between circuit boards to achieve a better usage rate of space.

The BTB connector is a connector assembly. Generally, the connector assembly includes an electrical plug connector and an electrical receptacle connector adapted to be mated with the electrical plug connector. A plurality of male terminals is arranged on the electrical plug connector, and a plurality of female terminals is arranged on the electrical receptacle connector. When the electrical plug connector is inserted into the electrical receptacle connector, the male terminals are mated with the female terminals for the signal connection between two printed circuit boards.

The female terminal of an existing electrical receptacle connector includes a main arm, a pair of clamping arms, and a soldering leg. The clamping arms are extended from one of two ends of the main arm and aligned parallel with each other. The soldering leg is extended from the other end of the main arm. Commonly, the clamping arms and the main arm define a U-shaped structure; in other words, the clamping arms are devoid of supporting structures. It is noticed that, because the clamping arms are devoid of supporting structures, when the clamping arms of the female terminals are in contact with the male terminals, the clamping arms would be deformed or broken easily once the inserting force applied to the electrical receptacle connector is too large or once the tolerance between the male terminals is too large.

SUMMARY OF THE INVENTION

Consequently, how to improve the existing electrical connectors becomes an issue and is diligently developed by the applicant.

In view of this, the instant disclosure provides an electrical plug connector. An embodiment of the electrical plug connector comprises a plug insulated housing and a plurality of plug terminals. The plug insulated housing comprises a plug bottom wall, a pair of first sidewalls, and a pair of first end walls. The pair of first sidewalls is configured to the plug bottom wall along a longitudinal direction. The pair of first end walls is configured to the plug bottom wall along a transversal direction. The pair of first sidewalls and the pair of first end walls define a first connecting space. Each of the plug terminals comprises a first contact portion, a second contact portion, and a first soldering portion. The first contact portion is located in the first connecting space and abutted against one of two surfaces of the corresponding first sidewall. The first contact portion defines a groove facing the first connecting space. The groove is at an outer lateral surface of the first contact portion. The second contact portion is located at the other surface of the corresponding first sidewall and aligned parallel to the first contact portion. One end of the second contact portion is extended to one of two ends of the first contact portion through a transition segment. A shaping space is defined between the first contact portion and the second contact portion. The second contact portion comprises an engaging recess. The engaging recess is formed on an outer lateral surface of the second contact portion, and the outer lateral surface of the second contact portion is opposite to the first contact portion. The first soldering portion is extended outward from the other end of the first contact portion and protruded from the plug bottom wall.

In some embodiments, the width of the portion of the first contact portion having the groove is less than the width of the transition segment, and the width of the portion of the second contact portion having the engaging recess is less than the width of the transition segment.

The instant disclosure also provides an electrical receptacle connector adapted to be mated with the aforementioned electrical plug connector. An embodiment of the electrical receptacle connector comprises a receptacle insulated housing and a plurality of receptacle terminals. The receptacle insulated housing comprises a receptacle bottom wall, a pair of second sidewalls, and a pair of second end walls. The pair of second sidewalls is configured to the receptacle bottom wall along a longitudinal direction. The pair of second end walls is configured to the receptacle bottom wall along a transversal direction. The pair of second sidewalls and the pair of second end walls define a second connecting space. The receptacle bottom wall comprises a tongue portion extended toward the second connecting space. Inner walls of the pair of second sidewalls and two sides of the tongue portion have a plurality of terminal grooves respectively arranged along the longitudinal direction. The terminal grooves are defined through the receptacle bottom wall and communicates with the second connecting space. The pair of second sidewalls comprises a plurality of fixing grooves. The fixing grooves are defined through the respective second sidewalls and correspond to the respective terminal grooves. The receptacle insulated housing comprises a plurality of abutting surfaces. The abutting surfaces are recessed and formed at inner lateral surfaces of the terminal grooves at the two sides of the tongue portion. Each of the receptacle terminals comprises a main arm, a pair of flexible arms, a fixing arm, and a second soldering portion. The main arm is disposed in the receptacle bottom wall. The pair of flexible arms comprises a first side arm and a second side arm. The first side arm and the second side arm are outward extended from one of two ends of the main arm toward the terminal grooves. Each of the first side arms is located in the corresponding terminal groove at the two sides of the tongue portion. Each of the second side arms is located in the corresponding terminal groove at the inner walls of the pair of second sidewalls. Each of the first side arms comprises a first contact end and a supporting arm. The first contact end is extended to the second connecting space. The supporting arm is opposite to the first contact end and inclinedly extended toward the adjacent abutting surface. The fixing arm is outward extended from the other end of the main arm into the corresponding fixing groove. The second soldering portion comprises a contact leg extended from the other end of the main arm and protruded out of the corresponding second sidewall.

The instant disclosure further provides an electrical receptacle connector adapted to be mated with the aforementioned electrical plug connector. An embodiment of the electrical receptacle connector comprises a receptacle insulated housing and a plurality of receptacle terminals. The receptacle insulated housing comprises a receptacle bottom wall, a pair of second sidewalls, and a pair of second end walls. The pair of second sidewalls is configured to the receptacle bottom wall along a longitudinal direction. The pair of second end walls is configured to the receptacle bottom wall along a transversal direction. The pair of second sidewalls and the pair of second end walls define a second connecting space. The receptacle bottom wall comprises a tongue portion extended toward the second connecting space. Inner walls of the pair of second sidewalls and two sides of the tongue portion have a plurality of terminal grooves respectively arranged along the longitudinal direction. The terminal grooves are defined through the receptacle bottom wall and communicates with the second connecting space. The pair of second sidewalls comprises a plurality of fixing grooves. The fixing grooves are defined through the respective second sidewalls and correspond to the respective terminal grooves. Each of the receptacle terminals comprises a main arm, a pair of flexible arms, a fixing arm, and a second soldering portion. The main arm is disposed in the receptacle bottom wall. The pair of flexible arms comprises a first side arm and a second side arm. The first side arm and the second side arm are outward extended from one of two ends of the main arm toward the terminal grooves. Each of the first side arms is located in the corresponding terminal groove at the two sides of the tongue portion. Each of the second side arms is located in the corresponding terminal groove at the inner walls of the pair of second sidewalls. Each of the second side arms comprises a supporting segment and a second contact end. The supporting segment is inclinedly extended from the main arm, and the second contact end is extended from a top of the supporting segment toward the second connecting space. The fixing arm is outward extended from the other end of the main arm into the corresponding fixing groove. The second soldering portion comprises a contact leg extended from the other end of the main arm and protruded out of the corresponding second sidewall.

The instant disclosure yet further provides an electrical receptacle connector adapted to be mated with the aforementioned electrical plug connector. An embodiment of the electrical receptacle connector comprises a receptacle insulated housing and a plurality of receptacle terminals. The receptacle insulated housing comprises a receptacle bottom wall, a pair of second sidewalls, and a pair of second end walls. The pair of second sidewalls is configured to the receptacle bottom wall along a longitudinal direction. The pair of second end walls is configured to the receptacle bottom wall along a transversal direction. The pair of second sidewalls and the pair of second end walls define a second connecting space. The receptacle bottom wall comprises a tongue portion extended toward the second connecting space. Inner walls of the pair of second sidewalls and two sides of the tongue portion have a plurality of terminal grooves respectively arranged along the longitudinal direction. The terminal grooves are defined through the receptacle bottom wall and communicates with the second connecting space. The pair of second sidewalls comprises a plurality of fixing grooves. The fixing grooves are defined through the respective second sidewalls and correspond to the respective terminal grooves. The receptacle insulated housing comprises a plurality of abutting surfaces. The abutting surfaces are recessed and formed at inner lateral surfaces of the terminal grooves at the two sides of the tongue portion. Each of the receptacle terminals comprises a main arm, a pair of flexible arms, a fixing arm, and a second soldering portion. The main arm is disposed in the receptacle bottom wall. The pair of flexible arms comprises a first side arm and a second side arm. The first side arm and the second side arm are outward extended from one of two ends of the main arm toward the terminal grooves. Each of the first side arms is located in the corresponding terminal groove at the two sides of the tongue portion. Each of the second side arms is located in the corresponding terminal groove at the inner walls of the pair of second sidewalls. Each of the first side arms comprises a first contact end and a supporting arm. The first contact end is extended to the second connecting space. The supporting arm is opposite to the first contact end and inclinedly extended toward the adjacent abutting surface. Each of the second side arms comprises a supporting segment and a second contact end. The supporting segment is inclinedly extended from the main arm, and the second contact end is extended from a top of the supporting segment toward the second connecting space. The fixing arm is outward extended from the other end of the main arm into the corresponding fixing groove. The second soldering portion comprises a contact leg extended from the other end of the main arm and protruded out of the corresponding second sidewall.

In some embodiments, the contact legs are adapted to connect a circuit board. A space is defined between each of the main arms and the circuit board when the contact legs are connected to the circuit board. Each of the receptacle terminals further comprises a convection groove recessed at the bottom of the main arm to define an air convection area. Each pair of flexible arms defines a notch structure between the main arm and the supporting arm.

According to the design of the supporting arm of the first side arm, when the plug terminal is abutted against the first side arm, the supporting arm is abutted against the abutting surface for supporting the first side arm and improving the structural strength of the first side arm. Therefore, the first side arm can be prevented from being deformed or broken which would possibly occur when the first side arm is unsupported. In addition, according to the design of the supporting segment of the second side arm, the flexibility of second side arm can be improved and the structural strength of the second side arm can be enhanced. Furthermore, the electrical plug connector and the electrical receptacle connector can be properly in contact with each other when being impacted or shaken. In addition, the supporting segment and the supporting arm are provided as buffers which share the force with the contact ends and prevent the side arms from being broken when in use.

Detailed description of the characteristics and the advantages of the instant disclosure, are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
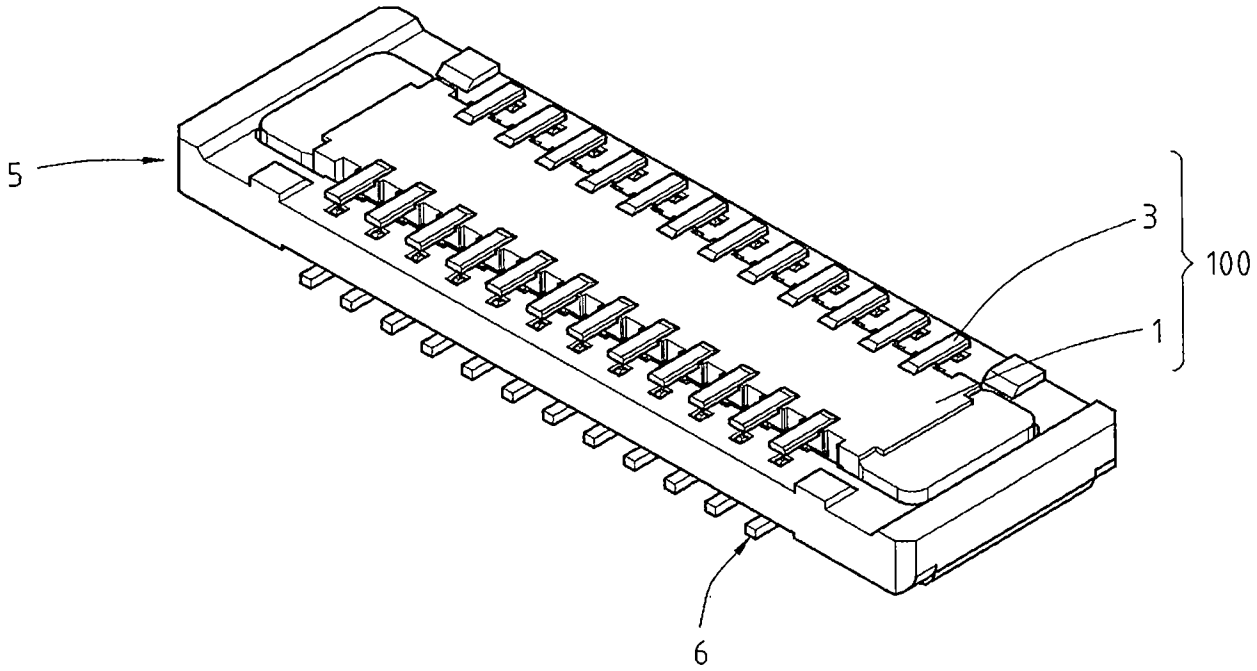
FIG. 1 illustrates a perspective view of an electrical connector assembly according to an exemplary embodiment of the instant disclosure.
Figure 2:
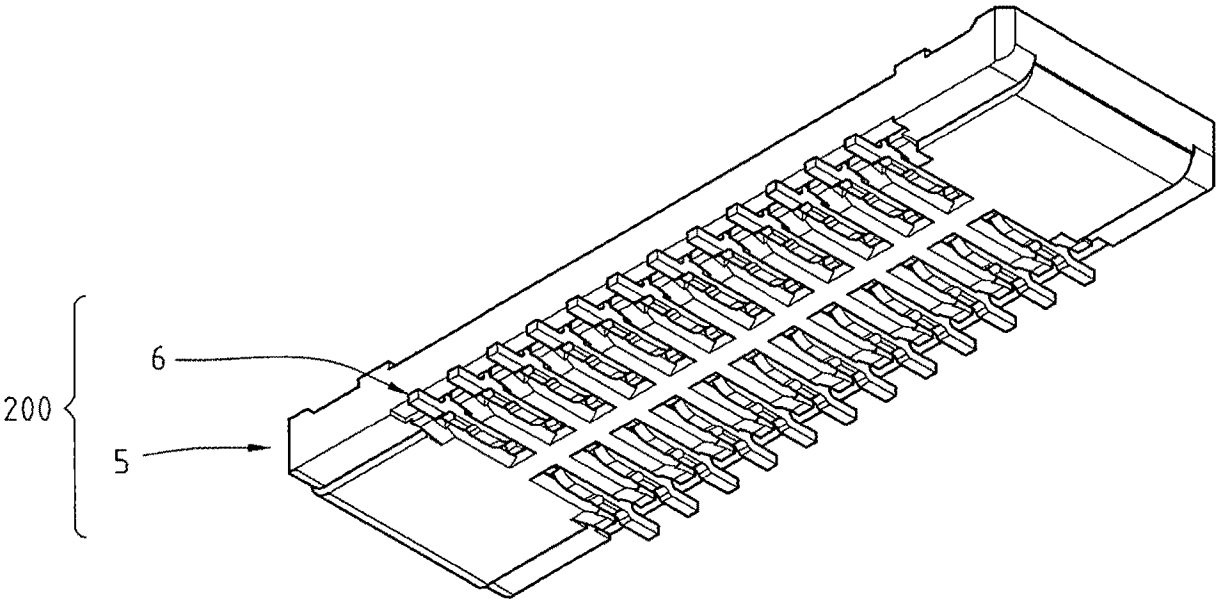
FIG. 2 illustrates another perspective view of the electrical connector assembly.
Figure 3:
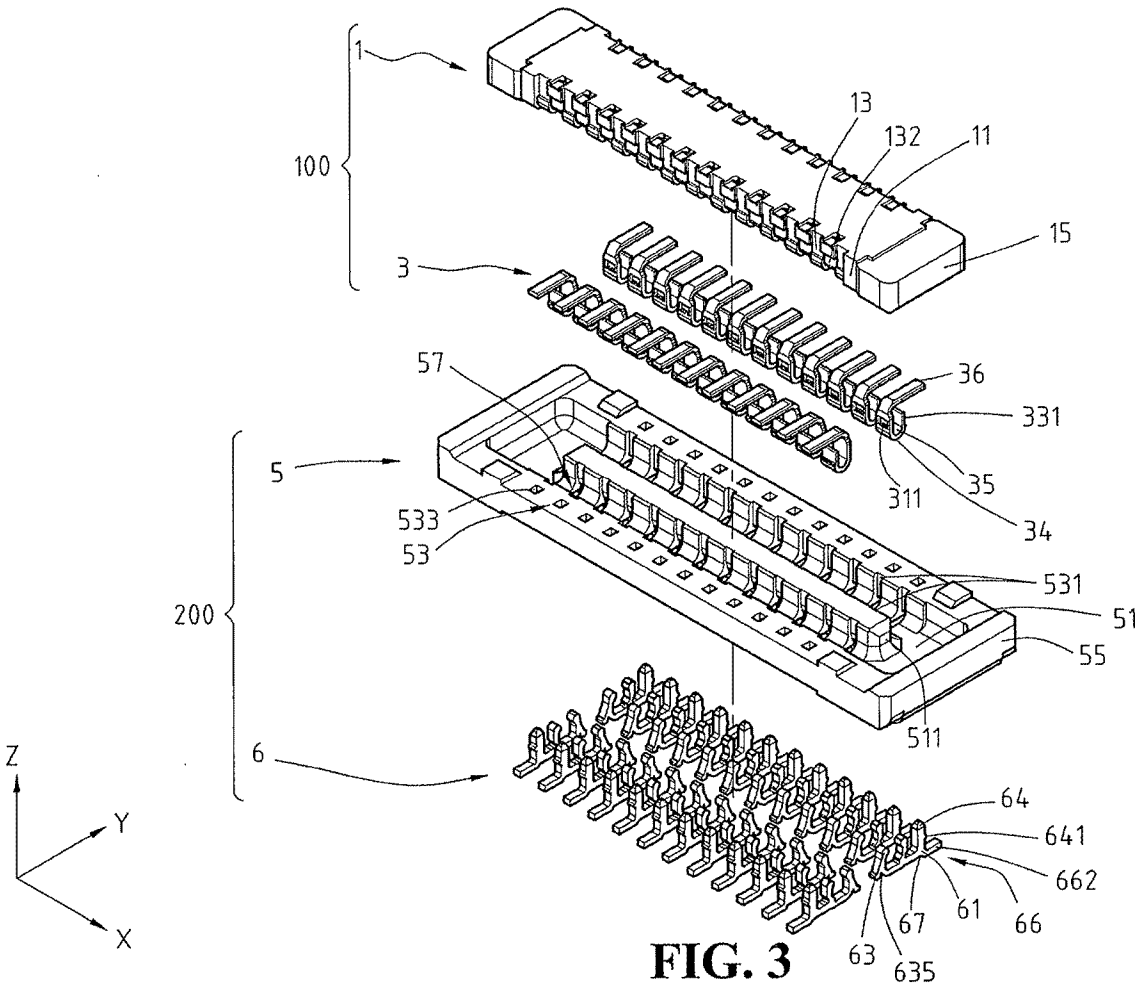
FIG. 3 illustrates an exploded view of the electrical connector assembly.
Figure 4:
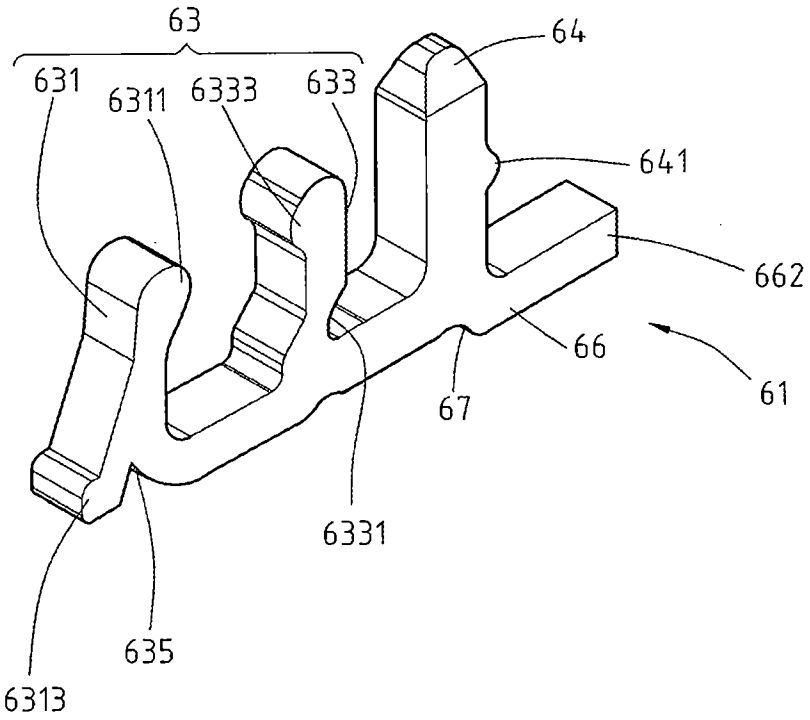
FIG. 4 illustrates a perspective view of a receptacle terminal of an electrical receptacle connector of the electrical connector assembly.

Please refer to FIG. 1, FIG. 2, and FIG. 3, which illustrate an electrical connector assembly of an exemplary embodiment according to the instant disclosure. FIG. 1 and FIG. 2 illustrate perspective views of the electrical connector assembly, and FIG. 3 illustrates an exploded view of the electrical connector assembly. The electrical connector assembly according to the embodiment comprises an electrical plug connector 100 and an electrical receptacle connector 200 adapted to be mated with the electrical plug connector 100. The electrical connector assembly belongs to board to board connectors (BTB connectors).

Figure 5:
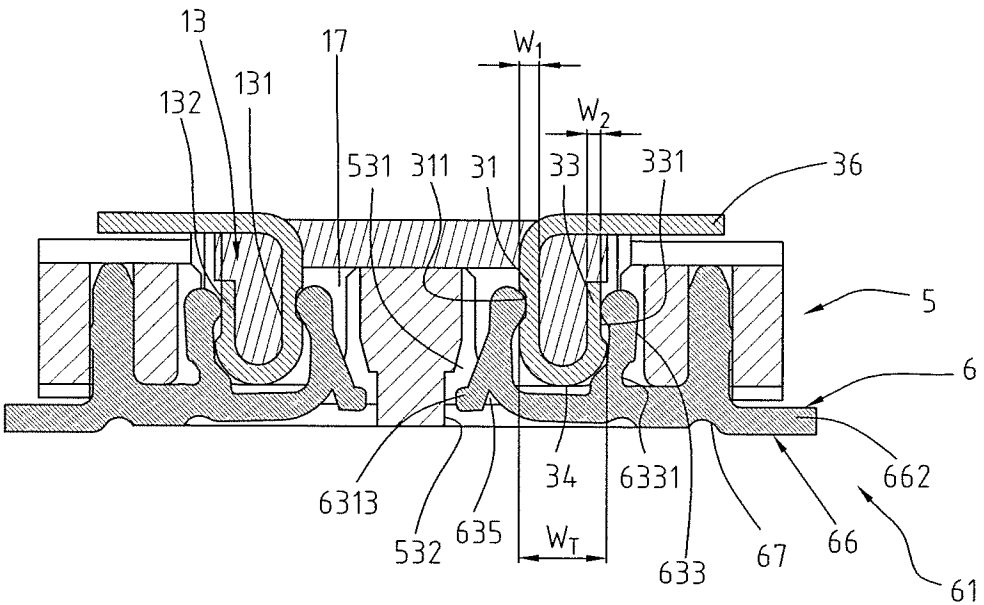
FIG. 5 illustrates a side sectional assembled view of the electrical connector assembly.

Please refer to FIG. 3 and FIG. 5, which illustrate an embodiment of the electrical plug connector 100. FIG. 5 illustrates a side sectional assembled view of the electrical connector assembly. The electrical plug connector 100 comprises a plug insulated housing 1 and a plurality of plug terminals 3. The plug insulated housing 1 is an elongated member made of plastics. The plug insulated housing 1 comprises a plug bottom wall 11, a pair of first sidewalls 13, and a pair of first end walls 15. The first sidewalls 13 are opposite to and parallel with each other. The first end walls 15 are opposite to and parallel with each other. Specifically, the pair of first sidewalls 13 is configured to the plug bottom wall 11 along a longitudinal direction X, and the pair of first end walls 15 is configured to the plug bottom wall 11 along a transversal direction Y. The pair of first sidewalls 13 and the pair of first end walls 15 are enclosed to define a first connecting space 17.

Please refer to FIG. 3 and FIG. 5. The plug terminals 3 are located at the plug insulated housing 1 and arranged into two parallel lines. Each of the plug terminals 3 comprises a first contact portion 31, a second contact portion 33, and a first soldering portion 36. The first contact portion 31, the second contact portion 33, and the first soldering portion 36 are integrally formed as a whole.

Please refer to FIG. 3 and FIG. 5. The first contact portion 31 is located in the first connecting space 17 and abutted against one of two surfaces (the inner lateral surface 131 or the outer lateral surface 132) of one of the first sidewalls 13. The first contact portion 31 defines a groove 311 at the outer lateral surface of the first contact portion 31 and faces the first connecting space 17. Moreover, the width W1 of the portion of the first contact portion 31 having the groove 311 is less than the width $W_T$ of a transition segment 34. In operation, the grooves 311 are provided for buckled with receptacle terminals 6 of an electrical receptacle connector 200, so that the electrical receptacle connector 200 can be properly mated with the electrical plug connector 100. In addition, during the mating between the electrical plug connector 100 and an electrical receptacle connector 200, an audible sound is generated when a receptacle terminal 6 of the electrical receptacle connector 200 is buckled in the groove 311, so that a user can be notified that the electrical plug connector 100 and the electrical receptacle connector 200 are properly mated with each other.

Please refer to FIG. 3 and FIG. 5. The second contact portion 33 is located at the other surface (the inner lateral surface 131 or the outer lateral surface 132) of one of the first sidewalls 13. One end of the second contact portion 33 is extended to one of two ends of the first contact portion 31 through the transition segment 34. In other words, the second contact portion 33 is extended from the first contact portion 31 through the transition segment 34, and the first contact portion 31 is substantially parallel to the second contact portion 33. The transition segment 34 is a U-shaped structure which facilitates the assembling and disassembling between the electrical plug connector 100 and the electrical receptacle connector 200. Because of the transition segment 34, the plug terminals 3 would not be damaged easily even when the electrical plug connector 100 is inserted into the electrical receptacle connector 200 by an overexerted force. A shaping space 35 is defined between the first contact portion 31 and the second contact portion 33. The shaping space is provided for receiving plastics which is for forming the first sidewalls 13. After the plastics in the shaping space 35 are set, the structural strength of the plug terminals 3 can be improved. Therefore, the plug terminals 3 can be prevented from being deformed when the electrical plug connector 100 is mated with the electrical receptacle connector 200.

Please refer to FIG. 3 and FIG. 5. The second contact portion 33 comprises an engaging recess 331. The engaging recess 331 is formed on an outer lateral surface of the second contact portion 33. In other words, the engaging recess 331 is formed on a lateral surface of the second contact portion 33 opposite to the first contact portion 31. In operation, the engaging recesses 331 are provided for buckling with receptacle terminals 6 of an electrical receptacle connector 200, so that the electrical receptacle connector 200 can be properly mated with the electrical plug connector 100. In addition, the engaging recesses 331 improve the operation of the electrical plug connector 100. In other words, since the width W2 of the portion of the second contact portion 33 having the engaging recess 331 is less than the width $W_T$ of the transition segment 34, the receptacle terminals 6 of the electrical receptacle connector 200 are guided by the engaging recesses 331 and engaged with the plug terminals 3 when the receptacle terminals 6 are inserted into the electrical plug connector 100. In addition, an audible sound is generated when the receptacle terminal 6 of the electrical receptacle connector 200 is buckled in the engaging recess 331, so that a user can be notified that the electrical plug connector 100 and the electrical receptacle connector 200 are properly mated with each other.

Please refer to FIG. 3 and FIG. 5. In this embodiment, the first soldering portion 36 is extended outward from the other end of the first contact portion 31 and protruded from the plug bottom wall 11. Parts of the first soldering portion 36 are processed by laser stripping technologies to produce a nickel barrier area. The nickel barrier area can efficiently stops the solder wicking so as to avoid solder elevation. In this embodiment, the first soldering portion 36 may be, but not limited to, extended outward from the other end of the first contact portion 31 along a direction from the first contact portion 31 to the second contact portion 33. Therefore, in this embodiment, the length of the first soldering portion 36 is longer and the area for soldering with a circuit board is wider, as compared to the embodiment to be introduced. Accordingly, the first soldering portion 36 can be properly assembled with the circuit board. In addition, since the length of the first soldering portion 36 is long enough, the solder can be prevented from continuously flowing toward the first contact portion 31 along the first soldering portion 36 (i.e., the solder wicking, which would possibly lead the solder soldered between the first solder portion 36 and the circuit board to be detached easily) when the first soldering portion 36 is soldered with the circuit board. In one embodiment, the first soldering portion 36 is extended outward from the other end of the first contact portion 31 along a direction from the second contact portion 33 to the first contact portion 31. In this embodiment, while the length of the first soldering portion 36 is shorter as compared to the foregoing embodiment, the length of the first soldering portion 36 is still long enough to allow the first soldering portion 36 to be soldered with the circuit board. Accordingly, the first soldering portion 36 can be properly assembled with the circuit board.

The electrical plug connector 100 is made by insert molding techniques, in which high-stability and high-strength liquid crystal polymers (LCP) are utilized to enclose parts of the plug terminals 3, and the rest parts of the plug terminals 3, i.e., the contact portions 31, 33, are exposed for mating with the electrical receptacle connector 200. The plug terminals 3 and the plug insulated housing 1 allow the solder and flux for surface mount technology to be isolated out of the liquid crystal polymers.

Figure 6:
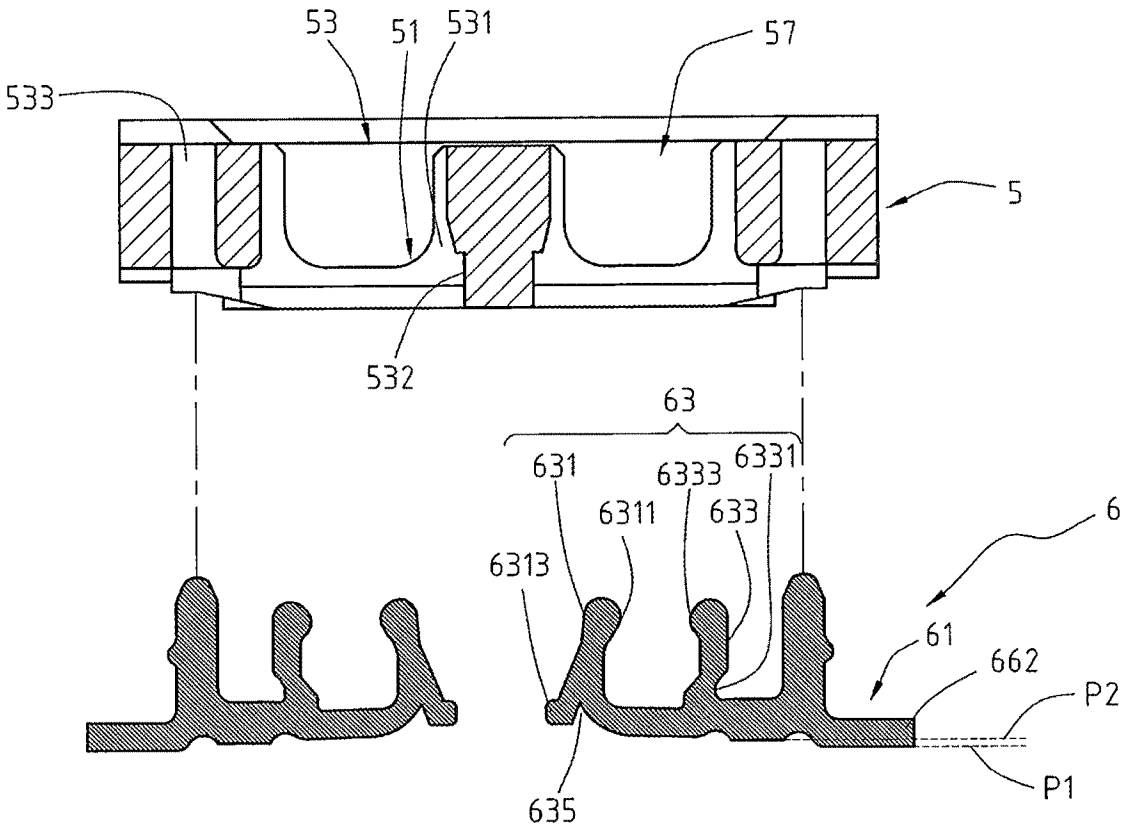
FIG. 6 illustrates a side sectional exploded view of the electrical receptacle connector of the electrical connector assembly.

Please refer to FIGS. 3 to 6, which illustrate an embodiment of the electrical receptacle connector 200. FIG. 6 illustrates a side sectional exploded view of the electrical receptacle connector 200. The electrical receptacle connector 200 comprises a receptacle insulated housing 5 and a plurality of receptacle terminals 6. The receptacle insulated housing 5 is an elongated member made of plastics. The receptacle insulated housing 5 comprises a receptacle bottom wall 51, a pair of second sidewalls 53, and a pair of second end walls 55. The pair of second sidewalls 53 is configured to the receptacle bottom wall 51 along the longitudinal direction X, and the pair of second end walls 55 is configured to the receptacle bottom wall 51 along the transversal direction Y. The pair of second sidewalls 53 and the pair of second end walls 55 define a second connecting space 57. When the electrical plug connector 100 is mated with the electrical receptacle connector 200, the pair of first sidewalls 13 is inserted into and received in the second connecting space 57.

Please refer to FIGS. 3 to 6. The receptacle bottom wall 51 of the electrical receptacle connector 200 comprises a tongue portion 511 extended toward the second connecting space 57. Inner walls of the pair of second sidewalls 53 and two sides of the tongue portion 511 have a plurality of terminal grooves 531 respectively arranged along the longitudinal direction X. The terminal grooves 531 are defined through the receptacle bottom wall 51 and communicates with the second connecting space 57. The pair of second sidewalls 53 comprises a plurality of fixing grooves 533. The fixing grooves 533 are defined through the respective second sidewalls 53 and correspond to the respective terminal grooves 531. In addition, the receptacle insulated housing 5 comprises a plurality of abutting surfaces 532. The abutting surfaces 532 are recessed and formed at inner lateral surfaces of the terminal grooves 531 at the two sides of the tongue portion 511.

Please refer to FIGS. 3 to 6. The receptacle terminals 6 are located at the receptacle insulated housing 5 and arranged into two parallel lines. Each of the receptacle terminals 6 comprises a main arm 61, a pair of flexible arms 63, a fixing arm 64, and a second soldering portion 66. In one embodiment, the receptacle terminals 6 are blanking type terminals. Spot plating techniques are applied to the receptacle terminals 6, and the wipe length of the receptacle terminal 6 is longer than that of a forming type terminal. Since the receptacle terminals 6 of the embodiment have longer wipe lengths, the dust and the oxidized layer on the surface of the receptacle terminals 6 can be eliminated efficiently.

Please refer to FIGS. 3 to 6. The main arm 61 is disposed below the receptacle bottom wall 51, and the length direction of the main arm 61 is aligned with the width direction of the receptacle bottom wall 51. The pair of flexible arms 63 is outward extended from out of two ends of the main arm 61 toward the terminal grooves 531. The pair of flexible arms 63 is a floating structure. That is, when the electrical receptacle connector 200 is mated with the electrical plug connector 100, the pair of flexible arms 63 swings with the fixing arm 64 as the center.

Please refer to FIGS. 3 to 6. The pair of flexible arms 63 comprises a first side arm 631 and a second side arm 633. The first side arm 631 and the second side arm 633 are outward extended from one of two ends of the main arm 61 toward the terminal groove 531. In this embodiment, each of the first side arms 631 is located in the corresponding terminal groove 531 at the two sides of the tongue portion 511, and each of the second side arms 633 is located in the corresponding terminal groove 531 at the inner walls of the pair of second sidewalls 53, embodiments are not limited thereto. In some embodiments, the second side arms 53 may be further located in the terminal grooves 531 at the two sides of the tongue portion 511. In other words, the positions of the second side arms 633 are changed to the positions of the first side arms 631; that is, in this embodiment, the structures of the first side arms 631 are the same as that of the second side arms 633, so that the first side arm 631 is mirrored with respect to its corresponding second side arm 633. In this embodiment, each of the second side arms 633 in the terminal grooves 531 of the two sides of the tongue portion 511 also has a supporting segment 6331, and each of the second side arms 633 in the terminal grooves 531 of the inner walls of the pair of second sidewalls 633 (i.e., the first side arms 631 in the forgoing embodiment) may have the supporting segment 6331.

Please refer to FIGS. 3 to 6. In this embodiment, the first side arm 631 comprises a first contact end 6311 and a supporting arm 6313. The first contact end 6311 is extended to the second connecting space 57. The supporting arm 6313 is opposite to the first contact end 6311 and inclinedly extended toward the adjacent abutting surface 532. In this embodiment, the flexible arm 63 defines a notch structure 635 between the main arm 61 and the supporting arm 6313. In addition, as shown in FIG. 6, the cross section of the first side arm 631 is of an upside down and mirrored y-profile which provides an anti-overstress function. Therefore, when the electrical plug connector 100 is inserted into the electrical receptacle connector 200, the inserting force can be shared by the first contact end 6311 and the supporting arm 6313. In other words, it is understood that once the inserting force is too large or once the tolerance between the plug terminals 3 is too large, the first side arms 631 are deflected outward greatly when the first side arms 631 are abutted against the plug terminals 3; while in this embodiment, the supporting arm 6313 can be in contact with the abutting surface 532, so that the first side arm 631 can be supported, improving the structural strength of the first side arm 631 and preventing the first side arm 631 from being deformed or damaged. Accordingly, the electrical plug connector 100 and the electrical receptacle connector 200 can be properly in contact with each other even when being impacted or shaken. In addition, the supporting arm 6313 is provided as a buffer which shares the force with first contact end 6311 and prevents the first side arm 631 from being broken when in use.

Please refer to FIGS. 3 to 6. In this embodiment, each of the second side arms 633 is located in the corresponding terminal groove 531 at the inner walls of the pair of second sidewalls 53. The second side arm 633 comprises a supporting segment 6331 and a second contact end 6333. The supporting segment 6331 is inclinedly extended from the main arm 61, and the second contact end 6333 is extended from a top of the supporting segment 6331 toward the second connecting space 57. In this embodiment, as shown in FIG. 6, the supporting segment 6331, the second contact end 6333, and the main arm 61 are collectively formed as an S-type flexible structure which improves the flexibility of the second side arm 633 and enhances the structural strength of the second side arm 633. In other words, the inserting force can be shared by the second contact end 6333 and the supporting segment 6331 when the second side arms 633 are abutted against the plug terminals 3. Accordingly, the electrical plug connector 100 and the electrical receptacle connector 200 can be properly in contact with each other even when being impacted or shaken. In addition, the supporting segment 6 is provided as a buffer which shares the force with the second contact end 6333 and prevents the second side arm 633 from being broken when in use.

Figure 7:
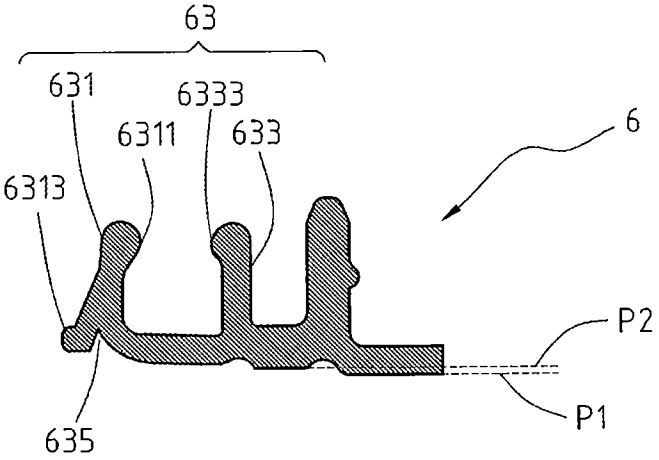
FIG. 7 illustrates a side sectional view of one embodiment of the receptacle terminal.
Figure 8:
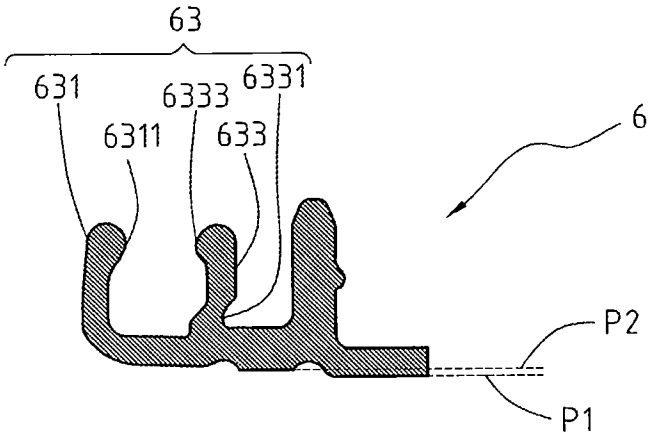
FIG. 8 illustrates a side sectional view of another embodiment of the receptacle terminal.

Please refer to FIGS. 3 to 6. In this embodiment, the first side arm 631 comprises the supporting arm 6313 and the second side arm 633 comprises the supporting segment 6331, but embodiments are not limited thereto. In some embodiments, for simplifying the structure and the manufacturing of the receptacle terminals 6, the first side arm 631 may be devoid of the supporting arm 6313 (as shown in FIG. 8) or the second side arm 633 may be devoid of the supporting segment 6331 (as shown in FIG. 7). In other words, as shown in FIG. 8, the first contact end 6311 is laterally extended from an end portion of the main arm 61, i.e., the first side arm 631 and the main arm 61 are formed as an L-profile; while, As shown in FIG. 7, the second side arm 633 is directly extended from an about-middle portion of the main arm 61, i.e., the second side arm 633 and the main arm 61 are formed as a reversed T-profile. The receptacle terminals 6 without the supporting arms 6313 can be efficiently in contact with the plug terminals 3 for signal transmission. Similarly, the receptacle terminals 6 without the supporting segments 6331 can be efficiently in contact with the plug terminals 3 for signal transmission.

Please refer to FIGS. 3 to 6. The first contact end 6311 and the second contact end 6333 are circular shaped. The upper part of the first contact end 6311 and that of the second contact end 6333 are gradually tapered inward (like the top portion of a funnel), so that the transition segments 34 of the plug terminals 3 can be smoothly guided by the first contact ends 6311 and the second contact ends 6333 when the electrical plug connector 100 is mated with the electrical receptacle connector 20Q. When the electrical plug connector 100 is mated with the electrical receptacle connector 200, the first contact end 6311 and the second contact end 6333 of each of the receptacle terminals 6 are in contact with the corresponding plug terminal 3 (i.e., in a dual contact manner), and the first side arm 631 and the second side arm 633 of each of the receptacle terminals 6 are flexible (i.e., dual floating) when mated with the corresponding plug terminal 3. Accordingly, the electrical receptacle connector 200 can be stably and properly mated with the electrical plug connector 100, and the receptacle terminals 6 would not detached from the plug terminals 3 easily because of the structures of the first contact ends 6311 and the second contact ends 6333.

Please refer to FIGS. 3 to 6. The fixing arm 64 is outward extended from the other end of the main arm 61 into the corresponding fixing groove 533. The fixing arm 64, the pair of flexible arms 63 and the main arm 61 are formed as a laid E-profile. In this embodiment, each of the receptacle terminals 6 further comprises an engaging block 641 protruded from a side portion of the fixing arm 64 and engaged in an inner lateral surface of the fixing groove 533. Based on this, the receptacle terminals 6 can be properly positioned on the receptacle insulated housing 5. In other words, the engaging block 641 allows the receptacle terminal 6 to be positioned with the receptacle insulated housing 5 stably. Accordingly, when the electrical plug connector 100 is mated with the electrical receptacle connector 200, the engaging block 641 is provided as a fulcrum to allow the pair of flexible arms 63 perform slight deflection, and the pair of flexible arms 63 of each of the receptacle terminals 6 is mated with the corresponding plug terminal 3 in a dual contact manner (i.e., by the first contact end 6311 and the second contact end 6333). Therefore, the electrical receptacle connector 200 and the electrical plug connector 100 can be stably mated with each other.

Please refer to FIGS. 3 to 6. The second soldering portion 66 comprises a bending portion and a contact leg 662. The bending portion is connected between the main arm 61 and the contact leg 662. In other words, the contact leg 662 is extended from the other end of the main arm 61 through the bending portion and the contact leg 662 is nearby the fixing arm 64. The contact leg 662 is adapted to connect a circuit board. A space is defined between the main arm 61 and the circuit board when the contact leg 662 is connected to the circuit board. That is, as shown in FIG. 6, when the receptacle terminal 6 is soldered on the circuit board, the surface of the contact leg 662 is in contact with the surface of the circuit board and located at a first horizontal plane P1, and the surface of the main arm 61 is located at a second horizontal plane P2. Therefore, a space is formed between the circuit board and the main arm 61 of the receptacle terminal 6 for air convection. In this embodiment, each of the receptacle terminals 5 further comprises a convection groove 67 recessed at the bottom of the main arm 61 to define an air convection area. Based on this, the convection grooves 67 facilitate the heat dissipation of the receptacle terminals 6 when the electrical receptacle connector 200 is in use. In addition, in this embodiment, the two c-shaped convection grooves 67 of the receptacle terminal 6 allow the soldering area of the receptacle terminal 6 to increase. Therefore, the fixation between the second soldering portion 66 and the circuit board can be improved, the solder and flux wicking issue can be prevented efficiently, and the overall defect-free rate of the electrical receptacle connector 200 can increase.

According to the design of the supporting arm of the first side arm, when the plug terminal is abutted against the first side arm, the supporting arm is abutted against the abutting surface for supporting the first side arm and improving the structural strength of the first side arm. Therefore, the first side arm can be prevented from being deformed or broken which would possibly occur when the first side arm is unsupported. In addition, according to the design of the supporting segment of the second side arm, the flexibility of second side arm can be improved and the structural strength of the second side arm can be enhanced. Furthermore, the electrical plug connector and the electrical receptacle connector can be properly in contact with each other when being impacted or shaken. In addition, the supporting segment and the supporting arm are provided as buffers which share the force with the contact ends and prevent the side arms from being broken when in use.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A board to board assembly, comprising:

an electrical plug connector, comprising:

a plug insulated housing comprising a plug bottom wall, a pair of first sidewalls, and a pair of first end walls, wherein the pair of first sidewalls is configured to the plug bottom wall along a longitudinal direction, the pair of first end walls is configured to the plug bottom wall along a transversal direction, the pair of first sidewalls and the pair of first end walls define a first connecting space; and a plurality of plug terminals, each located at the corresponding first sidewall, and each of the plug terminals comprising:

a first contact portion located in the first connecting space and abutted against one of two surfaces of the corresponding first sidewall, wherein the first contact portion defines a groove facing the first connecting space, the groove is at an outer lateral surface of the first contact portion;

a second contact portion located at the other surface of the corresponding first sidewall and aligned parallel to the first contact portion, wherein one end of the second contact portion is extended to one of two ends of the first contact portion through a transition segment, a shaping space is defined between the first contact portion and the second contact portion, and wherein the second contact portion comprises an engaging recess, the engaging recess is formed on an outer lateral surface of the second contact portion, and the outer lateral surface of the second contact portion is opposite to the first contact portion; and a first soldering portion, extended outward from the other end of the first contact portion and protruded from the plug bottom wall; and an electrical receptacle connector, comprising:

a receptacle insulated housing comprising a receptacle bottom wall, a pair of second sidewalls, and a pair of second end walls, wherein the pair of second sidewalls is configured to the receptacle bottom wall along a longitudinal direction, the pair of second end walls is configured to the receptacle bottom wall along a transversal direction, the pair of second sidewalls and the pair of second end walls define a second connecting space, the receptacle bottom wall comprises a tongue portion extended toward the second connecting space, inner walls of the pair of second sidewalls and two sides of the tongue portion have a plurality of terminal grooves respectively arranged along the longitudinal direction, the terminal grooves are defined through the receptacle bottom wall and communicates with the second connecting space, the pair of second sidewalls comprises a plurality of fixing grooves, the fixing grooves are defined through the respective second sidewalls and correspond to the respective terminal grooves, wherein the receptacle insulated housing comprises a plurality of abutting surfaces, the abutting surfaces are recessed and formed at inner lateral surfaces of the terminal grooves at the two sides of the tongue portion; and a plurality of receptacle terminals, each comprising:

a main arm disposed in the receptacle bottom wall;

a pair of flexible arms comprising a first side arm and a second side arm, the first side arm and the second side arm are outward extended from one of two ends of the main arm toward the terminal grooves, each of the first side arms is located in the corresponding terminal groove at the two sides of the tongue portion, each of the second side arms is located in the corresponding terminal groove at the inner walls of the pair of second sidewalls, wherein the first side arm comprises a first contact end and a supporting arm, the first contact end is extended to the second connecting space, and the supporting arm is opposite to the first contact end and inclinedly extended toward an adjacent one of the abutting surfaces, the second side arm comprises a second contact end, and the first contact end and the second contact end are circular shaped;

a fixing arm outward extended from the other end of the main arm into the corresponding fixing groove, wherein the fixing arm is extended in a same direction of the first side arm and the second side arm; and a second soldering portion comprising a contact leg extended from the other end of the main arm, being nearby the fixing arm, and protruded out of the corresponding second sidewall.

2. The board to board assembly according to claim 1, wherein the width of the portion of the first contact portion having the groove is less than the width of the transition segment.

3. The board to board assembly according to claim 1, wherein the width of the portion of the second contact portion having the engaging recess is less than the width of the transition segment.

4. An electrical receptacle connector, comprising:

a receptacle insulated housing comprising a receptacle bottom wall, a pair of second sidewalls, and a pair of second end walls, wherein the pair of second sidewalls is configured to the receptacle bottom wall along a longitudinal direction, the pair of second end walls is configured to the receptacle bottom wall along a transversal direction, the pair of second sidewalls and the pair of second end walls define a second connecting space, the receptacle bottom wall comprises a tongue portion extended toward the second connecting space, inner walls of the pair of second sidewalls and two sides of the tongue portion have a plurality of terminal grooves respectively arranged along the longitudinal direction, the terminal grooves are defined through the receptacle bottom wall and communicates with the second connecting space, the pair of second sidewalls comprises a plurality of fixing grooves, the fixing grooves are defined through the respective second sidewalls and correspond to the respective terminal grooves, wherein the receptacle insulated housing comprises a plurality of abutting surfaces, the abutting surfaces are recessed and formed at inner lateral surfaces of the terminal grooves at the two sides of the tongue portion; and a plurality of receptacle terminals, each comprising:

a main arm disposed in the receptacle bottom wall;

a pair of flexible arms comprising a first side arm and a second side arm, the first side arm and the second side arm are outward extended from one of two ends of the main arm toward the terminal grooves, each of the first side arms is located in the corresponding terminal groove at the two sides of the tongue portion, each of the second side arms is located in the corresponding terminal groove at the inner walls of the pair of second sidewalls, wherein the first side arm comprises a first contact end and a supporting arm, the first contact end is extended to the second connecting space, and the supporting arm is opposite to the first contact end and inclinedly extended toward an adjacent one of the abutting surfaces, the second side arm comprises a second contact end, and the first contact end and the second contact end are circular shaped;

a fixing arm outward extended from the other end of the main arm into the corresponding fixing groove, wherein the fixing arm is extended in a same direction of the first side arm and the second side arm; and a second soldering portion comprising a contact leg extended from the other end of the main arm, being nearby the fixing arm, and protruded out of the corresponding second sidewall.

5. The electrical receptacle connector according to claim 4, wherein the contact legs are adapted to connect a circuit board, and wherein a space is defined between each of the main arms and the circuit board when the contact legs are connected to the circuit board.

6. The electrical receptacle connector according to claim 4, wherein each of the receptacle terminals further comprises a convection groove recessed at the bottom of the main arm to define an air convection area.

7. The electrical receptacle connector according to claim 4, wherein each of the receptacle terminals further comprises an engaging block protruded from a side portion of the fixing arm and engaged in an inner lateral surface of the fixing groove.

8. The electrical receptacle connector according to claim 4, wherein each pair of flexible arms defines a notch structure between the main arm and the supporting arm.

9. An electrical receptacle connector, comprising:

a receptacle insulated housing comprising a receptacle bottom wall, a pair of second sidewalls, and a pair of second end walls, wherein the pair of second sidewalls is configured to the receptacle bottom wall along a longitudinal direction, the pair of second end walls is configured to the receptacle bottom wall along a transversal direction, the pair of second sidewalls and the pair of second end walls define a second connecting space, the receptacle bottom wall comprises a tongue portion extended toward the second connecting space, inner walls of the pair of second sidewalls and two sides of the tongue portion have a plurality of terminal grooves respectively arranged along the longitudinal direction, the terminal grooves are defined through the receptacle bottom wall and communicates with the second connecting space, the pair of second sidewalls comprises a plurality of fixing grooves, the fixing grooves are defined through the respective second sidewalls and correspond to the respective terminal grooves; and a plurality of receptacle terminals, each comprising:

a main arm disposed in the receptacle bottom wall;

a pair of flexible arms comprising a first side arm and a second side arm, the first side arm and the second side arm are outward extended from one of two ends of the main arm toward the terminal grooves, each of the first side arms is located in the corresponding terminal groove at the two sides of the tongue portion, each of the second side arms is located in the corresponding terminal groove at the inner walls of the pair of second sidewalls, wherein the first side arm comprises a first contact end and a supporting arm, the first contact end is extended to the second connecting space, and the supporting arm is opposite to the first contact end and inclinedly extended toward an adjacent one of the abutting surfaces, the second side arm comprises a supporting segment and a second contact end, the supporting segment is inclinedly extended from the main arm, the second contact end is extended from a top of the supporting segment toward the second connecting space and the first contact end and the second contact end are circular shaped;

a fixing arm outward extended from the other end of the main arm into the corresponding fixing groove, wherein the fixing arm is extended in a same direction of the first side arm and the second side arm; and a second soldering portion comprising a contact leg extended from the other end of the main arm, being nearby the fixing arm, and protruded out of the corresponding second sidewall.

10. The electrical receptacle connector according to claim 9, wherein the contact legs are adapted to connect a circuit board, and wherein a space is defined between each of the main arms and the circuit board when the contact legs are connected to the circuit board.

11. The electrical receptacle connector according to claim 9, wherein each of the receptacle terminals further comprises a convection groove recessed at the bottom of the main arm to define an air convection area.

12. The electrical receptacle connector according to claim 9, wherein each of the receptacle terminals further comprises an engaging block protruded from a side portion of the fixing arm and engaged in an inner lateral surface of the fixing groove.

13. The electrical receptacle connector according to claim 9, wherein each pair of flexible arms defines a notch structure between the main arm and the supporting arm.

14. An electrical receptacle connector, comprising:

a receptacle insulated housing comprising a receptacle bottom wall, a pair of second sidewalls, and a pair of second end walls, wherein the pair of second sidewalls is configured to the receptacle bottom wall along a longitudinal direction, the pair of second end walls is configured to the receptacle bottom wall along a transversal direction, the pair of second sidewalls and the pair of second end walls define a second connecting space, the receptacle bottom wall comprises a tongue portion extended toward the second connecting space, inner walls of the pair of second sidewalls and two sides of the tongue portion have a plurality of terminal grooves respectively arranged along the longitudinal direction, the terminal grooves are defined through the receptacle bottom wall and communicates with the second connecting space, wherein the receptacle insulated housing comprises a plurality of abutting surfaces, the abutting surfaces are recessed and formed at inner lateral surfaces of the terminal grooves at the two sides of the tongue portion; and a plurality of receptacle terminals, each comprising:

a main arm disposed in the receptacle bottom wall;

a pair of flexible arms comprising a first side arm and a second side arm, the first side arm and the second side arm are outward extended from one of two ends of the main arm toward the terminal grooves, each of the first side arms is located in the corresponding terminal groove at the two sides of the tongue portion, each of the second side arms is located in the corresponding terminal groove at the inner walls of the pair of second sidewalls, wherein the first side arm comprises a first contact end and a supporting arm, the first contact end is extended to the second connecting space, the supporting arm is opposite to the first contact end and inclinedly extended toward an adjacent one of the abutting surfaces, the second side arm comprises a supporting segment and a second contact end, the supporting segment is inclinedly extended from the main aim, the second contact end is extended from a top of the supporting segment toward the second connecting space, and the first contact end and the second contact end are circular shaped;

a fixing arm outward extended from the other end of the main arm into the corresponding fixing groove, wherein the fixing arm is extended in a same direction of the first side arm and the second side arm; and a second soldering portion comprising a contact leg extended from the other end of the main arm, being nearby the fixing arm, and protruded out of the corresponding second sidewall.

15. The electrical receptacle connector according to claim 14, wherein the contact legs are adapted to connect a circuit board, and wherein a space is defined between each of the main arms and the circuit board when the contact legs are connected to the circuit board.

16. The electrical receptacle connector according to claim 14, wherein each of the receptacle terminals further comprises a convection groove recessed at the bottom of the main arm to define an air convection area.

17. The electrical receptacle connector according to claim 14, wherein each of the receptacle terminals further comprises an engaging block protruded from a side portion of the fixing arm and engaged in an inner lateral surface of the fixing groove.

18. The electrical receptacle connector according to claim 14, wherein each pair of flexible arms defines a notch structure between the main arm and the supporting arm.

* * * * *